US005091929A

United States Patent [19]

Grady

[11] Patent Number: 5,091,929

[45] Date of Patent: Feb. 25, 1992

[54] INTEGRATED X-RAY TUBE AND POWER SUPPLY

[76] Inventor: John K. Grady, XRE Corporation, 300 Foster St., Littleton, Mass. 01460

[21] Appl. No.: 591,959

[22] Filed: Oct. 2, 1990

Related U.S. Application Data

[63] Continuation of Ser. No. 390,272, Aug. 7, 1989, abandoned.

[51] Int. Cl.[5] ..... H05G 1/08

[52] U.S. Cl. ..... 378/197; 378/101; 378/102; 378/199

[58] Field of Search ..... 378/101, 102, 193, 197, 378/199, 201, 198, 200, 202, 203, 190, 189, 125, 142

[56] References Cited

U.S. PATENT DOCUMENTS

| | | | |
|---|---|---|---|
| 1,645,643 | 10/1927 | Crook | 378/101 |
| 4,104,525 | 8/1978 | Franke | 378/194 |
| 4,161,671 | 7/1979 | Klinkert | 378/144 |
| 4,200,796 | 4/1980 | Murakami et al. | 378/102 |
| 4,720,844 | 1/1988 | Bougle | 378/101 |
| 4,768,215 | 8/1988 | Kiwaki et al. | 378/101 |
| 4,856,036 | 8/1989 | Malcolm et al. | 378/190 |

*Primary Examiner*—Janice A. Howell
*Assistant Examiner*—David P. Porta
*Attorney, Agent, or Firm*—James H. Grover

[57] ABSTRACT

An X-ray stand with two hollow arms for supporting an X-ray tube and an X-ray receptor contains within one hollow arm a grounded anode X-ray tube and a non-inductive Cockcroft-Walton voltage multiplier power supply also grounded at one end to the support arm. The hollow arm forms a chamber filled with insulating fluid surrounding both the X-ray tube and its voltage multiplier. The voltage multiplier and X-ray tube plug together physically and electrically within the oil filled arm.

21 Claims, 3 Drawing Sheets

INTEGRATED X-RAY TUBE AND POWER SUPPLY

This is a continuation of application Ser. No. 07/390,272, filed Aug. 7, 1989 now abandoned.

BACKGROUND OF THE INVENTION

In conventional X-ray apparatus the X-ray tube is supplied with high voltage from a power supply through high voltage cables. Except in the special case of low power dental equipment, the high voltage cables must extend many feet from a massive remote high voltage power supply to an arm of the frame supporting the X-ray tube and its receptor, and require thick, high voltage insulation. At least two thick cables are required, each having a substantial capacitance to ground which introduces a slow voltage rise time causing a delay in the application of high voltage to the X-ray tube, and usually a delay in the turn off of X-ray exposure. In addition to being bulky and expensive, the cables are prone to fail in operation particularly when the X-ray tube ionizes near the end of its life.

In conventional metal center X-ray tubes the cathode is at a high negative potential and the envelope of the tube, its rotating anode and anode drive rotor are at a high positive potential. The tube therefor is customarily enclosed in a metal housing additional to its vacuum envelope to shield the high voltage and non-useful radiation from operator and patient. Operation of an X-ray tube also generates such high heat as to limit the length and intensity of X-ray exposure due to thermal limitations of the anode material used, tungsten for example.

Accordingly it is the object of the present invention to provide an X-ray tube and power supply which eliminates the additional housing for the tube envelope, improves the heat dissipation, and eliminates the expense and bulk of high voltage cables and cable connectors, remote power supplies, and the need for heavy power transformers in the supporting arm for the tube.

SUMMARY OF THE INVENTION

According to the invention angiographic X-ray apparatus comprises a base, an arm mounted on the base, an X-ray tube supported by the arm, and a high voltage power supply having a direct physical and electrical connection to the tube. Preferably the power supply is a voltage multiplier into which the tube is plugged, and the tube and supply to which it is attached are contained within a hollow, oil-filled arm.

In a further aspect the rotating anode of the X-ray tube, its drive motor and the metal tube vacuum envelope are grounded to the support arm, and all of the accelerating potential is applied to the cathode. Very high voltage power transformers are eliminated from the arm or other immediate support for the X-ray tube by virtue of a diode-capacitor voltage multiplier type of high voltage power supply which can be connected physically and electrically directly to the X-ray tube.

DRAWING

DESCRIPTION

Figure 1:
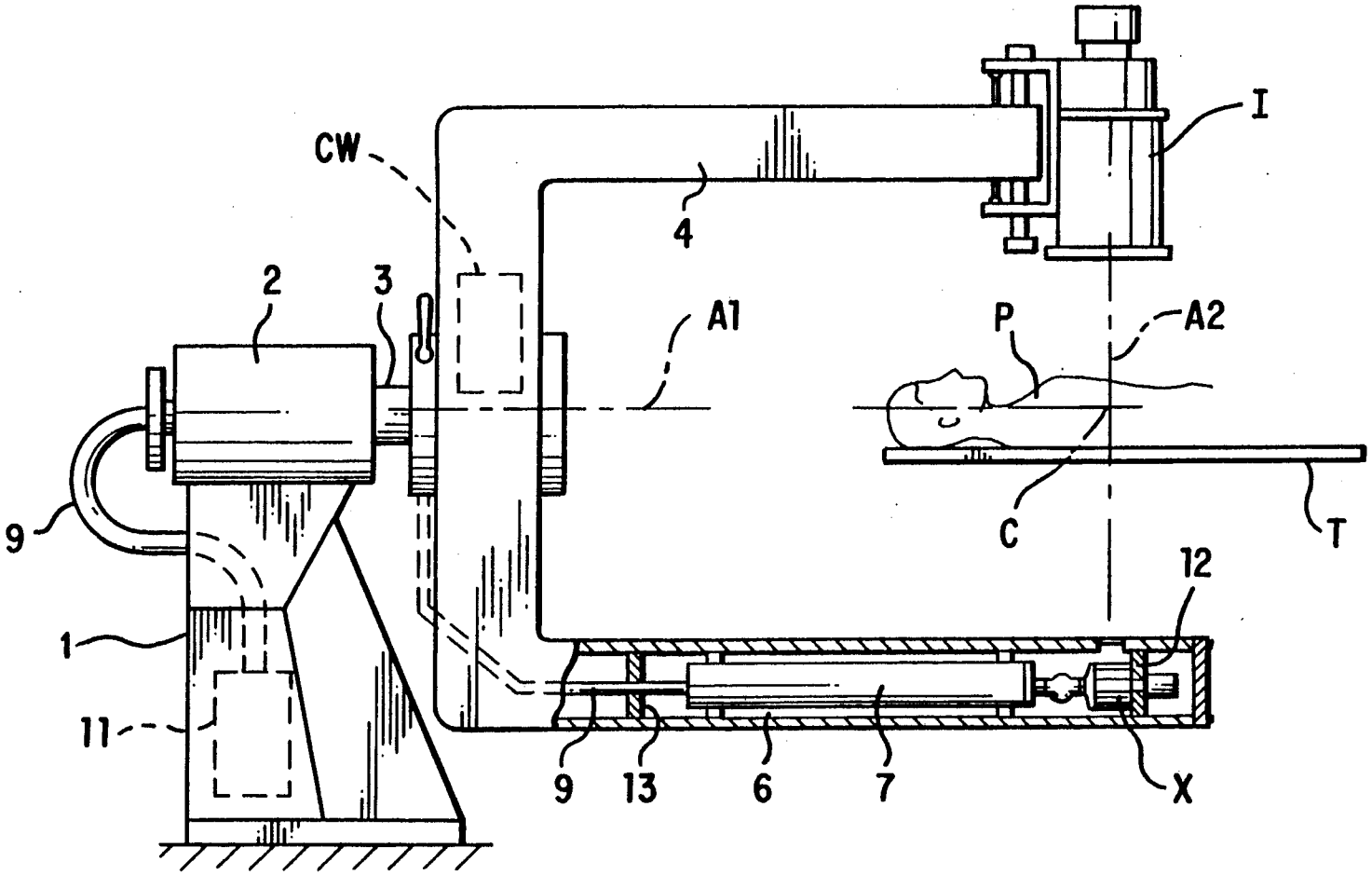
FIG. 1 is a side elevation of X-ray apparatus with an arm supporting an X-ray tube and power supply according to the invention.

In FIG. 1 is shown high power X-ray apparatus including a floor mounted base 1 with a bearing house 2 in which a hollow shaft 3 rotates on an axis A1. The shaft carries a two armed metal support 4,6, which is shown in U-shape, but may be C-shaped, One metal arm 4 carries an image intensifier 1 or other X-ray receptor centered on a radiation axis A2 from an X-ray tube X. Movement of the image intensifier is balanced by a counterweight CW. The radiation axis intersects the rotational axis at an isocenter C within a patient P on a table T.

Figure 2:
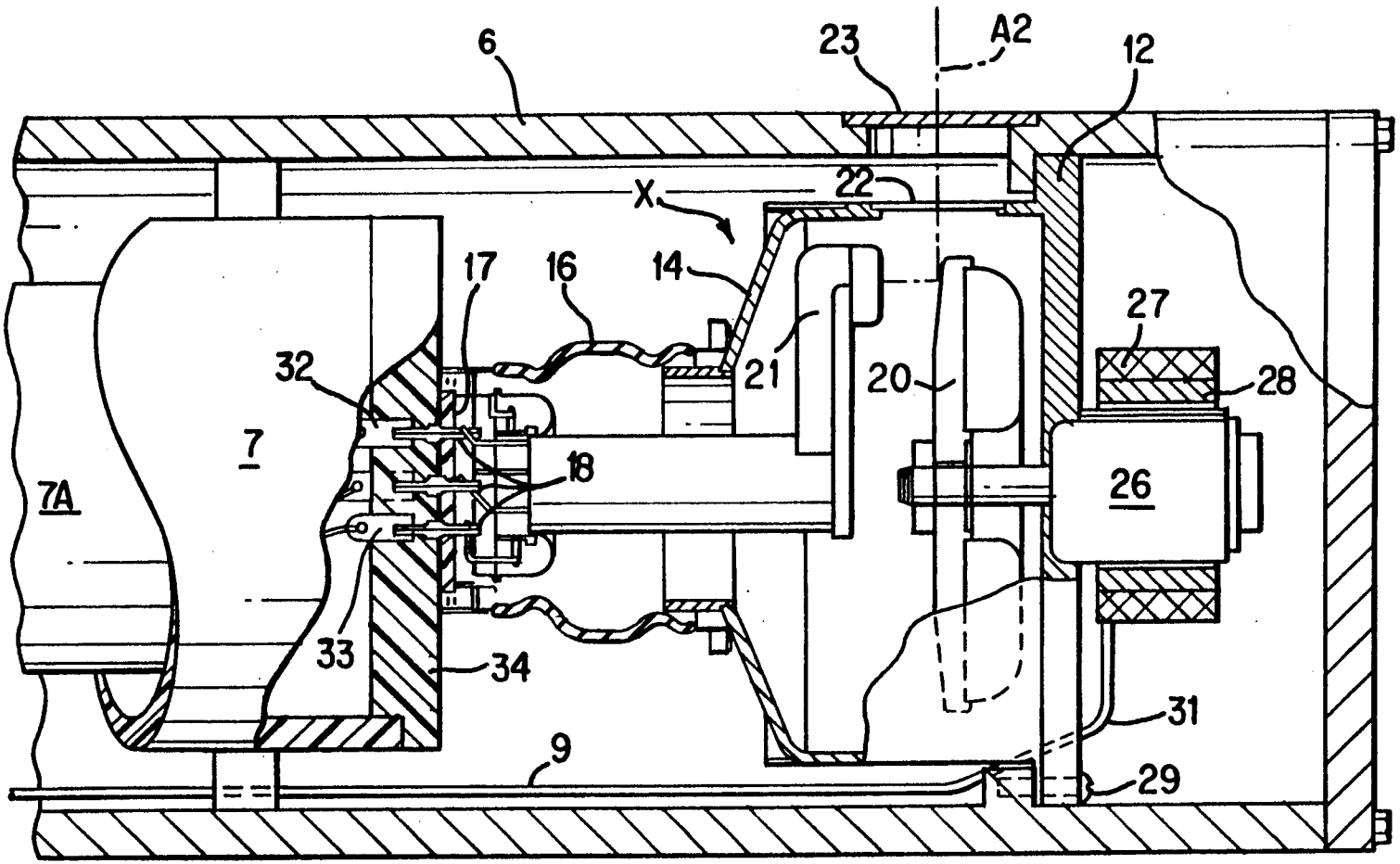
FIG. 2 is an enlarged side elevation of the support arm, tube and power supply, shown partly in section.
Figure 3B:
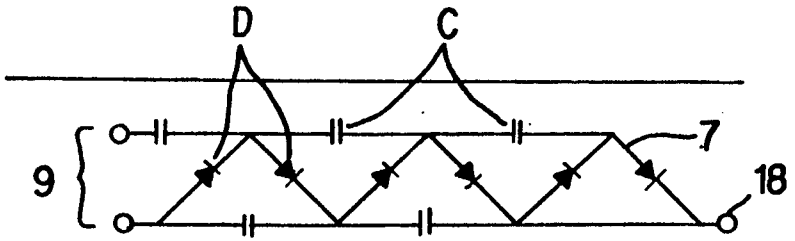
FIGS. 3A and 3B are a Cockcroft-Walton Voltage multiplier.
Figure 4:
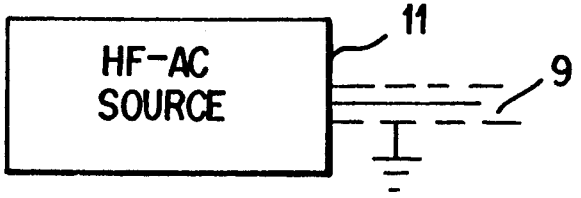
FIG. 4 is a conventional alternating current supply for providing various frequencies.
Figure 3A:
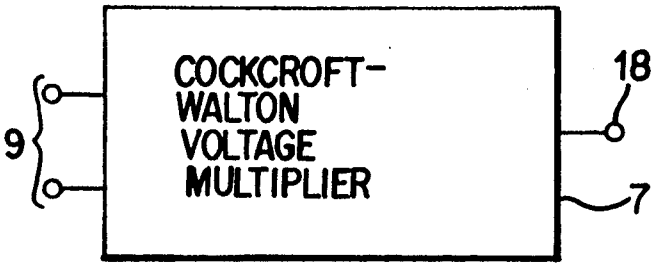

As shown in greater detail in FIG. 2, the X-ray tube support arm 6 is hollow and also contains a high voltage power supply 7 for the X-ray tube. The high voltage supply is preferably a Cockcroft-Walton voltage multiplier of the non-inductive, diode-capacitor type with diodes D and capacitors C, connected through a single-conductor, coaxial cable 9 to a high frequency alternating current source 11, e.g. 50 to 100 kilohertz at 10 kilovolts. A suitable coaxial cable 9 is one half inch or less in diameter compared to the two required one inch cables previously used. The X-ray tube X has an external flange member 12 snugly fitting the inside shape of the hollow arm 6 whether it be rectanglar, round or other similar outline. At the opposite end of the voltage multiplier 7 is a wall 13 which with the flange 12 seals the voltage multiplier and X-ray tube in a compartment which is preferably oil-filled. The coaxial cable 9 extends from the voltage multiplier 7 through the wall 13, thence outside the hollow arm, into the hollow shaft 3, and out of the shaft to the AC source 11 inside the base 1.

FIG. 2 shows the X-ray tube X and the voltage multiplier 7, the latter having an outer insulating housing and an inner chassis or container 7A. The tube has a metal envelope 14 with the previously mentioned flange 12 at one end, and a glass or ceramic neck 16 extending to an insulative base plate 17 having four filament terminals 18, of which only three are shown. The terminals 18 are connected through a stem 19 to a head 21 containing three cathode filaments of different sizes and electron emission intensities. Emitted electrons are focussed on a rotating anode 20 which generates X-rays along the radiation axis A2 through a window 22 in the metal envelope and a window 23 in the arm 6. The anode is rotated on a shaft 24 journalled in the bearings of a rotor 26 within a stator windings 27 on a core 28.

The filament terminals 18 mounted in the base of the X-ray tube form a plug which is physically and electrically connected to a socket consisting of mating conductors 33 on the end wall 34 of the outer, insulative housing of the voltage multiplier. The high voltage supply is thus connected directly to the X-ray tube with no intermediate cabling.

The metal flange 12 of the tube is secured by machine screws 29 to an internal flange 31 of the hollow arm 6 so as to seal off that one end of the arm beyond the flange. Beyond the other end of the voltage multiplier 7 the hollow arm is sealed by the wall 13 shown in FIG. 1. When the compartment between the flange and wall is filled with oil or a similar electrically insulating gas such as SF6, high voltage breakdown is minimized around the high voltage filament end of the X-ray tube.

Because the flange 12 of the X-ray tube is electrically as well as physically connected to the metal arm 6, a low resistance circuit to ground at the base 1 extends from the X-ray tube, including its envelope 14, anode 20 and drive stator 26 and rotor 27. Heat generated at the anode is better conducted from the tube, and it is believed that generation of heat at the anode due to secondary electrons landing on the anode is significantly reduced by virtue of its grounding within its grounded metal envelope. Also the ground terminal of the voltage multiplier is connected to the same ground as the tube. High voltage insulation of the multiplier in the oil filled arm reduces arcing, and the significantly lower voltage needed to be conducted to the multiplier, which is physically and electrically directly connected to the X-ray tube, greatly reduces cable failure and cable bulk and expense.

It should be understood that the present disclosure is for the purpose of illustration only, and that the invention includes all modifications and equivalents falling within the scope of the appended claims.

I claim:

1. X-ray apparatus comprising:

a base, a hollow arm mounted on the base, an X-ray tube supported by the arm, and a high voltage supply for the X-ray tube; wherein the X-ray tube has a rotating anode generating substantial heat and is mounted within the hollow arm;

the high voltage supply for the tube is also mounted within the hollow arm and includes a direct electrical connection to the tube within the arm; and the X-ray tube has a metal envelope including an external member electrically, mechanically and thermally connected to the inside of the hollow arm so as to dissipate heat from the rotating anode as well as connect it electrically to ground and position it within the hollow arm.

2. Apparatus according to claim 1 wherein the power supply is a non-inductive voltage multiplier.

3. Apparatus according to claim 2 wherein the power supply is a Cockcroft-Walton voltage multiplier, and the X-ray tube anode and the multiplier are connected to the same ground.

4. Apparatus according to claim 1 wherein the hollow arm includes walls forming a closed, oil filled compartment around the tube and power supply.

5. Apparatus according to claim 1 wherein the power supply is a non-inductive voltage multiplier connected to the same ground as the X-ray tube.

6. Apparatus according to claim 1 wherein the X-ray tube contains a stator for rotating the anode, the stator being electrically connected to the external member and therefor grounded.

7. Apparatus according to claim 1 wherein the power supply is enclosed within a container in the arm.

8. Apparatus according to claim 1 wherein the container seals the power supply from an oil fill.

9. Apparatus according to claim 4 wherein the container seals the power supply from the oil fill.

10. Apparatus according to claim 1 wherein the power supply comprises a diode-capacitor voltage multiplier.

11. Apparatus according to claim 10 wherein the voltage multiplier is grounded at one end.

12. Apparatus according to claim 10 wherein the voltage multiplier power supply is supplied by a single shielded conductor.

13. Apparatus according to claim 10 wherein the voltage multiplier power supply is supplied by a single conductor.

14. Apparatus according to claim 12 including a high voltage radio frequency source for the power supply.

15. X-ray apparatus comprising:

a base, an arm mounted on the base, an X-ray tube including a rotating anode supported by the arm, and a high voltage supply for the X-ray tube; wherein:

the X-ray tube, the high voltage supply and the anode for the tube have a direct physical, thermal and electrical connection to the arm.

16. Apparatus according to claim 15 wherein the tube and power supply include mating electrical connectors.

17. Apparatus according to claim 16 wherein the mating connectors comprise a plug and socket.

18. Apparatus according to claim 16 wherein the high voltage supply comprises a non-inductive voltage multiplier.

19. Apparatus according to claim 18 wherein the voltage multiplier is grounded at on end.

20. Apparatus according to claim 16 wherein the X-ray tube has an anode connected to ground.

21. Apparatus according to claim 19 wherein the X-ray tube has an anode connected to the same ground as the voltage multiplier.

* * * * *